US006014621A

United States Patent [19]

Chen

[11] Patent Number: 6,014,621

[45] **Date of Patent: *Jan. 11, 2000**

[54] SYNTHESIS OF SPEECH SIGNALS IN THE ABSENCE OF CODED PARAMETERS

[75] Inventor: Juin-Hwey Chen, Neshanic Station, N.J.

[73] Assignee: Lucent Technologies Inc., Murray Hill, N.J.

[ * ] Notice: This patent issued on a continued prosecution application filed under 37 CFR 1.53(d), and is subject to the twenty year patent term provisions of 35 U.S.C. 154(a)(2).

[21] Appl. No.: 08/831,841

[22] Filed: Apr. 2, 1997

Related U.S. Application Data

[63] Continuation of application No. 08/530,780, Sep. 19, 1995.

[51] Int. Cl.[7] ..... G10L 3/02; G10L 9/00

[52] U.S. Cl. ..... 704/220; 704/219; 704/229

[58] Field of Search ..... 704/219, 220, 704/229, 268

[56] References Cited

U.S. PATENT DOCUMENTS

| | | | |
|---|---|---|---|
| Re. 32,580 | 1/1988 | Atal et al. | 381/40 |
| 5,081,681 | 1/1992 | Hardwick | 704/223 |
| 5,127,053 | 6/1992 | Koch | 381/31 |
| 5,311,561 | 5/1994 | Akagiri | 375/122 |
| 5,314,457 | 5/1994 | Jeutter et al. | 607/116 |
| 5,327,520 | 7/1994 | Chen | 395/2.28 |
| 5,450,522 | 9/1995 | Hermansky et al. | 395/2.2 |
| 5,469,474 | 11/1995 | Kitabatake | 704/230 |
| 5,475,789 | 12/1995 | Nishiguchi | 395/2 |
| 5,533,052 | 7/1996 | Bhaskar | 704/230 |

FOREIGN PATENT DOCUMENTS

| | | | |
|---|---|---|---|
| PCT/US90/01905 | 11/1990 | European Pat. Off. | G10L 5/00 |
| 0 673 014 A2 | 3/1995 | European Pat. Off. | G10L 9/14 |

OTHER PUBLICATIONS

W.W. Chang et. al., "Audio Coding Masking–Threshold Adapted Perceptual Filter," *Proc. IEEE Workshop Speech Coding for Telecomm.*, pp. 9–10, Oct. 1993.

L.R. Rabiner et. al., *Digital Processing of Speech Signals*, Prentice–Hall, Inc., Englewood Cliffs, NJ, 1978.

Y. Tohkura et. al., "Spectral Smoothing Technique in PARCOR Speech Analysis–Synthesis," *IEEE Trans. Acoust., Speech, Signal Processing*, ASSP–26:587–596, Dec. 1978.

J.H. Chen, "A Robust Low–Delay CELP Speech Coder at 16 kbit/s, " *Proc. IEEE Global Comm. Conf.*, pp. 1237–1241, Dallas, TX, Nov. 1989.

F.K. Soong et. al., "Line Spectrum Pair (LSP) and Speech Data Compression," *Proc. IEEE Int. Conf. Acoust., Speech, Signal Processing*, pp. 1.10.1–1.10.4, Mar. 1984.

K.K. Paliwal et. al., "Efficient Vector Quantization of LPC Parameters at 24 bits/frame," *Proc. IEEE Int. Conf. Acoust., Speech, Signal Processing*, pp. 661–664, Toronto, Canada, May 1991.

(List continued on next page.)

*Primary Examiner*—David R. Hudspeth
*Assistant Examiner*—Robert Louis Sax
*Attorney, Agent, or Firm*—Thomas A. Restaino; Kenneth M. Brown

[57] ABSTRACT

A speech compression system called "Transform Predictive Coding", or TPC, provides for encoding 7 kHz wideband speech (16 kHz sampling) at a target bit-rate range of 16 to 32 kb/s (1 to 2 bits/sample). The system uses short-term and long-term prediction to remove the redundancy in speech. A prediction residual is transformed and coded in the frequency domain to take advantage of knowledge in human auditory perception. The TPC coder uses only open-loop quantization and therefore has a fairly low complexity. The speech quality of TPC is essentially transparent at 32 kb/s, very good at 24 kb/s, and acceptable at 16 kb/s.

6 Claims, 6 Drawing Sheets

OTHER PUBLICATIONS

N. Jayant et. al., "Signal Compression Based on Models of Human Perception," *Proc. IEEE,* pp. 1385–1422, Oct. 1993.
J.V. Tobias, ed., *Foundations of Modern Auditory Theory,* Academic Press, New York and London, 1970.
M.R. Schroeder et. al., "Optimizing Digital Speech Coders by Exploiting Masking Properties of the Human Ear," *J. Acoust. Soc. Amer.,* 66:1647–1652, Dec. 1979.
Y. Mahieux et al., "High–Quality Audio Transform Coding At 64 kbps," IEEE Transactions on Comm., 42 (1994) Nov., No. 11, New York, US, pp. 3010–3019.
M. R. Schroeder, "Optimizing digital speech coders by exploiting masking properties of the human ear," J. Acust. Soc. Am. 66(6), Dec. 1979, pp. 1647–1652.

N. S. Jayant et al. "Signal Compression Based On Models of Human Perception," Proc. of IEEE, vol. 81, No. 10, Oct. 1993.

Azirani et al, Optimizing speech enchancement by exploiting masking properties of the human ear, IEEE trans ASSP, pp. 800–803, May 1995.

*FIG. 6*
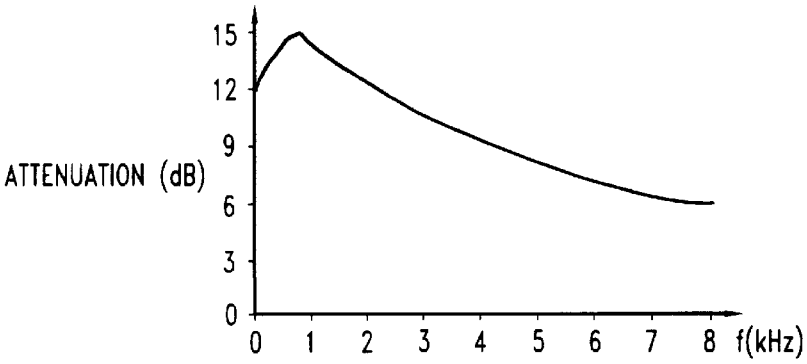
*FIG. 7*
| LPC INFORMATION | PITCH PREDICTION | GAINS (37) | MAIN INFORMATION |
|---|---|---|---|
| 7 VECTORS AT 7 BITS EACH (49) | PITCH-8BITS TAPS-6BITS (14) | HIGH FREQ: 5BITS<br>LOW FREQ: 4BITS<br>HIGH FREQ INT: 14BITS<br>LOW FREQ INT: 14BITS | AT 16Kbls-222BITS<br>24Kbls-380BITS<br>32Kbls-540BITS |
SIDE INFORMATION
*FIG. 8*
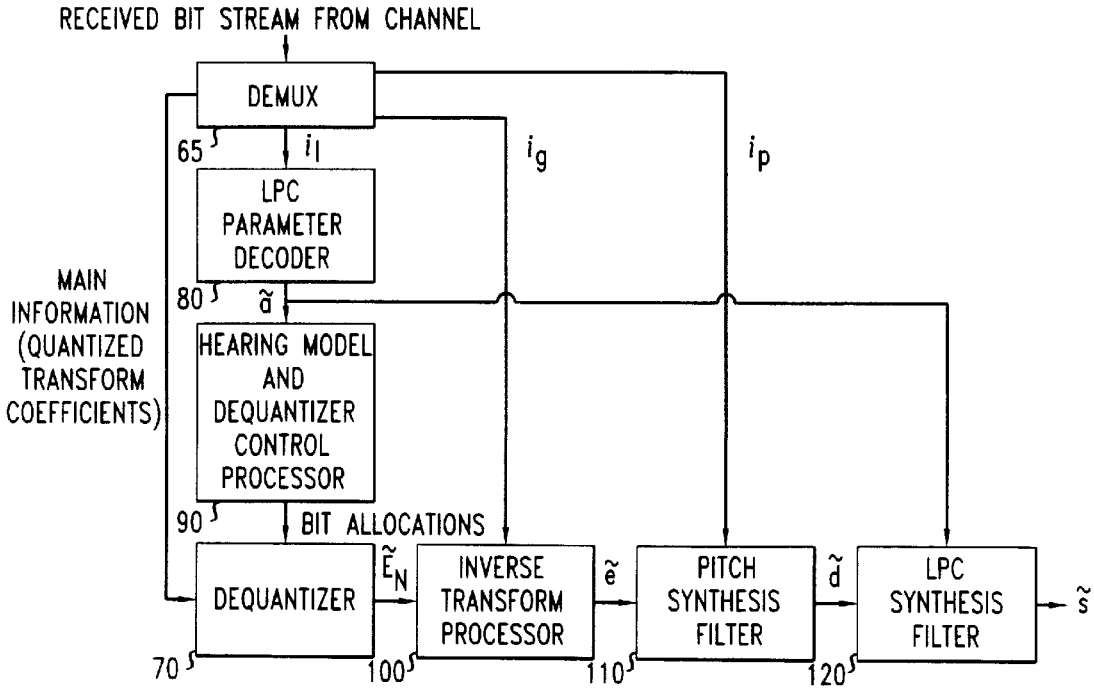

SYNTHESIS OF SPEECH SIGNALS IN THE ABSENCE OF CODED PARAMETERS

This application is a continuation of application Ser. No. 08/530,780, filed on Sep. 9, 1995.

FIELD OF THE INVENTION

The present invention relates to the compression (coding) of audio signals, for example, speech signals, using a predictive coding system.

BACKGROUND OF THE INVENTION

As taught in the literature of signal compression, speech and music waveforms are coded by very different coding techniques. Speech coding, such as telephone-bandwidth (3.4 kHz) speech coding at or below 16 kb/s, has been dominated by time-domain predictive coders. These coders use speech production models to predict speech waveforms to be coded. Predicted waveforms are then subtracted from the actual (original) waveforms (to be coded) to reduce redundancy in the original signal. Reduction in signal redundancy provides coding gain. Examples of such predictive speech coders include Adaptive Predictive Coding, Multi-Pulse Linear Predictive Coding, and Code-Excited Linear Prediction (CELP) Coding, all well known in the art of speech signal compression.

On the other hand, wideband (0–20 kHz) music coding at or above 64 kb/s has been dominated by frequency-domain transform or sub-band coders. These music coders are fundamentally very different from the speech coders discussed above. This difference is due to the fact that the sources of music, unlike those of speech, are too varied to allow ready prediction. Consequently, models of music sources are generally not used in music coding. Instead, music coders use elaborate human hearing models to code only those parts of the signal that are perceptually relevant. That is, unlike speech coders which commonly use speech production models, music coders employ hearing—sound reception—models to obtain coding gain.

In music coders, hearing models are used to determine a noise masking capability of the music to be coded. The term "noise masking capability" refers to how much quantization noise can be introduced into a music signal without a listener noticing the noise. This noise masking capability is then used to set quantizer resolution (e.g., quantizer stepsize). Generally, the more "tonelike" music is, the poorer the music will be at masking quantization noise and, therefore, the smaller the required quantizer stepsize will be, and vice versa. Smaller stepsizes correspond to smaller coding gains, and vice versa. Examples of such music coders include AT&T's Perceptual Audio Coder (PAC) and the ISO MPEG audio coding standard.

In between telephone-bandwidth speech coding and wideband music coding, there lies wideband speech coding, where the speech signal is sampled at 16 kHz and has a bandwidth of 7 kHz. The advantage of 7 kHz wideband speech is that the resulting speech quality is much better than telephone-bandwidth speech, and yet it requires a much lower bit-rate to code than a 20 kHz audio signal. Among those previously proposed wideband speech coders, some use time-domain predictive coding, some use frequency-domain transform or sub-band coding, and some use a mixture of time-domain and frequency-domain techniques.

The inclusion of perceptual criteria in predictive speech coding, wideband or otherwise, has been limited to the use of a perceptual weighting filter in the context of selecting the best synthesized speech signal from among a plurality of candidate synthesized speech signals. See, e.g., U.S. Pat. No. Re. 32,580 to Atal et al. Such filters accomplish a type of noise shaping which is useful in reducing noise in the coding process. One known coder attempts to improve upon this technique by employing a perceptual model in the formation of that perceptual weighting filter. See W. W. Chang et al., "Audio Coding Using Masking-Threshold Adapted Perceptual Filter," *Proc. IEEE Workshop Speech Coding for Telecomm.*, pp. 9–10, October 1993.

SUMMARY OF THE INVENTION

An illustrative embodiment of the present invention, referred to as "Transform Predictive Coding", or TPC, encodes 7 kHz wideband speech at a target bit-rate of 16 to 32 kb/s. As its name implies, TPC combines transform coding and predictive coding techniques in a single coder. More specifically, the coder uses linear prediction to remove the redundancy from the input speech waveform and then use transform coding techniques to encode the resulting prediction residual. The transformed prediction residual is quantized based on knowledge in human auditory perception, expressed in terms of a auditory perceptual model, to encode what is audible and discard what is inaudible.

An important feature of the illustrative embodiment concerns how the TPC coder allocates bits among coder frequencies and how the decoder generates a quantized output signal based on the allocated bits. In certain circumstances, the TPC coder allocates bits only to a portion of the audio band (for example, bits may be allocated to coefficients between 0 and 4 kHz, only). No bits are allocated to represent coefficients between 4 kHz and 7 kHz and, thus, the decoder gets no coefficients in this frequency range. Such a circumstance occurs when, for example, the TPC coder has to operate at very low bit rates, e.g., 16 kb/s. Despite having no bits representing the coded signal in the 4 kHz and 7 kHz frequency range, the decoder must still synthesize a signal in this range if it is to provide a wideband response. According to this feature of the embodiment, the decoder generates—that is, synthesizes—coefficient signals in this range of frequencies based on other available information—a ratio of an estimate of the signal spectrum (obtained from LPC parameters) to a noise masking threshold at frequencies in the range. Phase values for the coefficients are selected at random. By virtue of this technique, the decoder can provide a wideband response without the need to transmit speech signal coefficients for the entire band.

The potential applications of a wideband speech coder include ISDN video-conferencing or audio-conferencing, multimedia audio, "hi-fi" telephony, and simultaneous voice and data (SVD) over dial-up lines using modems at 28.8 kb/s or higher.

BRIEF DESCRIPTION OF THE DRAWINGS

FIG. 6 presents an attenuation function of an LPC power spectrum used in determining a masking threshold for adaptive bit allocation.

FIG. 7 presents a general bit allocation of the coder embodiment of FIG. 1.

FIG. 8 presents an illustrative decoder embodiment of the present invention.

DETAILED DESCRIPTION

A. Introduction to the Illustrative Embodiments

For clarity of explanation, the illustrative embodiment of the present invention is presented as comprising individual functional blocks (including functional blocks labeled as "processors"). The functions these blocks represent may be provided through the use of either shared or dedicated hardware, including, but not limited to, hardware capable of executing software. For example, the functions of processors presented in FIGS. 1–5 and 8 may be provided by a single shared processor. (Use of the term "processor" should not be construed to refer exclusively to hardware capable of executing software.)

Illustrative embodiments may comprise digital signal processor (DSP) hardware, such as the AT&T DSP16 or DSP32C, read-only memory (ROM) for storing software performing the operations discussed below, and random access memory (RAM) for storing DSP results. Very large scale integration (VLSI) hardware embodiments, as well as custom VLSI circuitry in combination with a general purpose DSP circuit, may also be provided.

Figure 1:
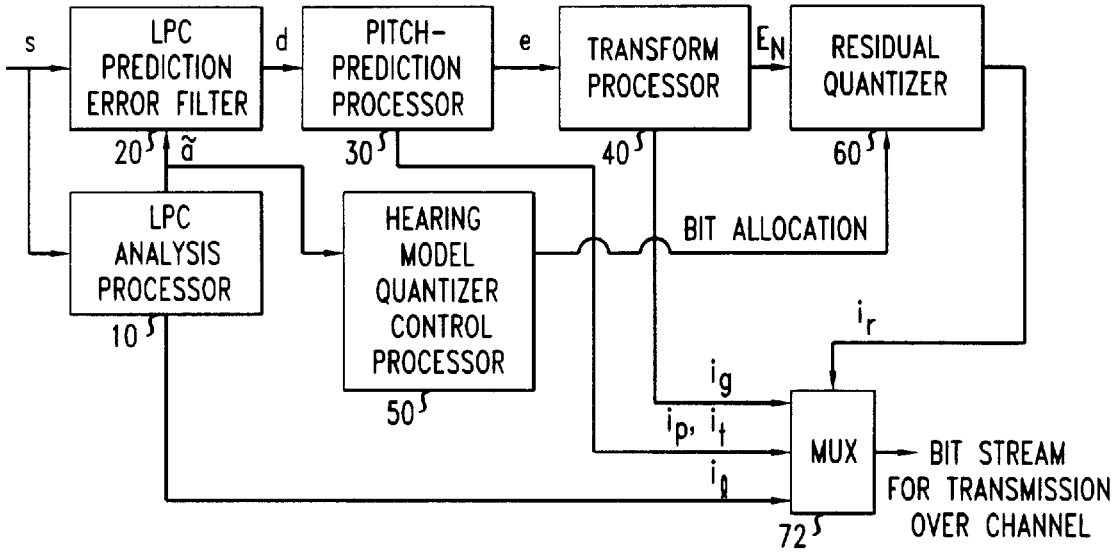
FIG. 1 presents an illustrative coder embodiment of the present invention.

FIG. 1 presents an illustrative TPC speech coder embodiments of the present invention. The TPC coder comprises an LPC analysis processor 10, an LPC (or "short-term") prediction error filter 20, a pitch-prediction (or "long-term" prediction) processor 30, a transform processor 40, a hearing model quantizer control processor 50, a residual quantizer 60, and a bit stream multiplexer (MUX) 72.

In accordance with the embodiment, short-term redundancy is removed from an input speech signal, s, by the LPC prediction error filter 20. The resulting LPC prediction residual signal, d, still has some long-term redundancy due to the pitch periodicity in voiced speech. Such long-term redundancy is then removed by the pitch-prediction processor 30. After pitch prediction, the final prediction residual signal, e, is transformed into the frequency domain by transform processor 40 which implements a Fast Fourier Transform (FFT). Adaptive bit allocation is applied by the residual quantizer 60 to assign bits to prediction residual FFT coefficients according to their perceptual importance as determined by the hearing model quantizer control processor 50.

Codebook indices representing (a) the LPC predictor parameters ($i_l$); (b) the pitch predictor parameters ($i_p$, $i_t$); (c) the transform gain levels ($i_g$); and (d) the quantized prediction residual ($i_r$) are multiplexed into a bit stream and transmitted over a channel to a decoder as side information. The channel may comprise any suitable communication channel, including wireless channels, computer and data networks, telephone networks; and may include or consist of memory, such as, solid state memories (for example, semiconductor memory), optical memory systems (such as CD-ROM), magnetic memories (for example, disk memory), etc.

The TPC decoder basically reverses the operations performed at the encoder. It decodes the LPC predictor parameters, the pitch predictor parameters, and the gain levels and FFT coefficients of the prediction residual. The decoded FFT coefficients are transformed back to the time domain by applying an inverse FFT. The resulting decoded prediction residual is then passed through a pitch synthesis filter and an LPC synthesis filter to reconstruct the speech signal.

To keep the complexity as low as possible, open-loop quantization is employed by the TPC. Open-loop quantization means the quantizer attempts to minimize the difference between the unquantized parameter and its quantized version, without regard to the effects on the output speech quality. This is in contrast to, for example, CELP coders, where the pitch predictor, the gain, and the excitation are usually close-loop quantized. In closed-loop quantization of a coder parameter, the quantizer codebook search attempts to minimize the distortion in the final reconstructed output speech. Naturally, this generally leads to a better output speech quality, but at the price of a higher codebook search complexity.

B. An Illustrative Coder Embodiment

1. The LPC Analysis and Prediction

Figure 2:
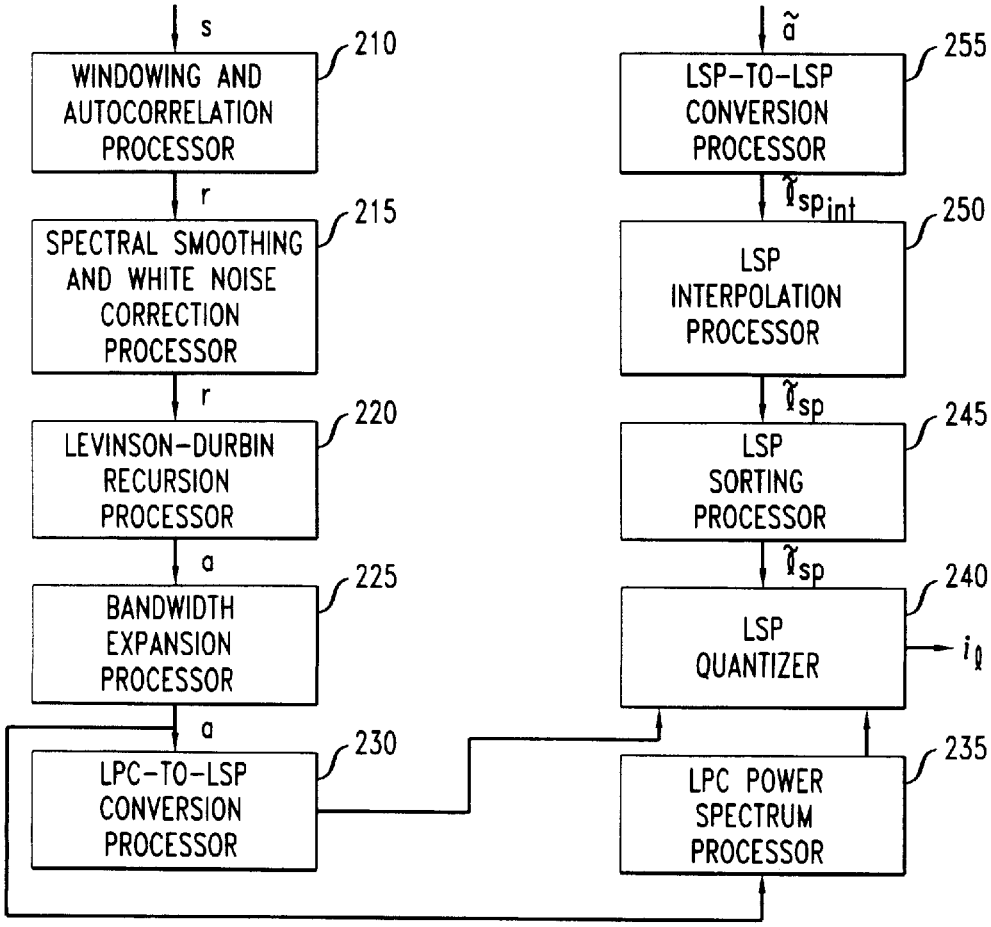
FIG. 2 presents a detailed block diagram of the LPC analysis processor of FIG. 1.

A detailed block diagram of LPC analysis processor 10 is presented in FIG. 2. Processor 10 comprises a windowing and autocorrelation processor 210; a spectral smoothing and white noise correction processor 215; a Levinson-Durbin recursion processor 220; a bandwidth expansion processor 225; an LPC to LSP conversion processor 230; and LPC power spectrum processor 235; an LSP quantizer 240; an LSP sorting processor 245; an LSP interpolation processor 250; and an LSP to LPC conversion processor 255.

Windowing and autocorrelation processor 210 begins the process of LPC coefficient generation. Processor 210 generates autocorrelation coefficients, r, in conventional fashion, once every 20 ms from which LPC coefficients are subsequently computed, as discussed below. See Rabiner, L. R. et al., *Digital Processing of Speech Signals*, Prentice-Hall, Inc., Englewood Cliffs, N.J., 1978 (Rabiner et al.). The LPC frame size is 20 ms (or 320 speech samples at 16 kHz sampling rate). Each 20 ms frame is further divided into 5 subframes, each 4 ms (or 64 samples) long. LPC analysis processor uses a 24 ms Hamming window which is centered at the last 4 ms subframe of the current frame, in conventional fashion.

To alleviate potential ill-conditioning, certain conventional signal conditioning techniques are employed. A spectral smoothing technique (SST) and a white noise correction technique are applied by spectral smoothing and white noise correction processor 215 before LPC analysis. The SST, well-known in the art (Tohkura, Y. et al., "Spectral Smoothing Technique in PARCOR Speech Analysis-Synthesis," IEEE Trans. Acoust., Speech, Signal Processing, ASSP-26:587–596, December 1978 (Tohkura et al.)) involves multiplying an calculated autocorrelation coefficient array (from processor 210) by a Gaussian window whose Fourier transform corresponds to a probability density function (pdf) of a Gaussian distribution with a standard deviation of 40 Hz. The white noise correction, also conventional (Chen, J.-H., "A Robust Low-Delay CELP Speech Coder at 16 kbit/s, *Proc. IEEE Global Comm. Conf.*, pp. 1237–1241, Dallas, Tex., November 1989.), increases the zero-lag autocorrelation coefficient (i.e., the energy term) by 0.001%.

The coefficients generated by processor 215 are then provided to Levinson-Durbin recursion processor 220, which generates 16 LPC coefficients, $a_i$ for i=1,2, . . . ,16 (the order of the LPC predictor 20 is 16) in conventional fashion.

Bandwidth expansion processor 225 multiplies each $a_i$ by a factor $g^i$, where $g^i$=0.994, for further signal conditioning. This corresponds to a bandwidth expansion of 30 Hz. (Tohkura et al.).

After such a bandwidth expansion, the LPC predictor coefficients are converted to the Line Spectral Pair (LSP) coefficients by LPC to LSP conversion processor 230 in conventional fashion. See Soong, F. K. et al., "Line Spectrum Pair (LSP) and Speech Data Compression," *Proc. IEEE Int. Conf. Acoust., Speech, Signal Processing*, pp. 1.10.1–1.10.4, March 1984 (Soong et al.), which is incorporated by reference as if set forth fully herein.

Vector quantization (VQ) is then provided by vector quantizer 240 to quantize the resulting LSP coefficients. The specific VQ technique employed by processor 240 is similar to the split VQ proposed in Paliwal, K. K. et al., "Efficient Vector Quantization of LPC Parameters at 24 bits/frame," *Proc. IEEE Int. Conf. Acoust., Speech, Signal Processing*, pp. 661–664, Toronto, Canada, May 1991 (Paliwal et al.), which is incorporated by reference as if set forth fully herein. The 16-dimensional LSP vector is split into 7 smaller sub-vectors having the dimensions of 2, 2, 2, 2, 2, 3, 3, counting from the low-frequency end. Each of the 7 sub-vectors are quantized to 7 bits (i.e., using a VQ codebook of 128 codevectors). Thus, there are seven codebook indices, $i_l(1)$–$i_l(7)$, each index being seven bits in length, for a total of 49 bits per frame used in LPC parameter quantization. These 49 bits are provided to MUX 70 for transmission to the decoder as side information.

Processor 240 performs its search through the VQ codebook using a conventional weighted mean-square error (WMSE) distortion measure, as described in Paliwal et al. The codebook used is determined with conventional codebook generation techniques well-known in the art. A conventional MSE distortion measure can also be used instead of the WMSE measure to reduce the coder's complexity without too much degradation in the output speech quality.

Normally LSP coefficients monotonically increase. However, quantization may result in a disruption of this order. This disruption results in an unstable LPC synthesis filter in the decoder. To avoid this problem, the LSP sorting processor 245 sorts the quantized LSP coefficients to restore the monotonically increasing order and ensure stability.

The quantized LSP coefficients are used in the last subframe of the current frame. Linear interpolation between these LSP coefficients and those from the last subframe of the previous frame is performed to provide LSP coefficients for the first four subframes by LSP interpolation processor 250, as is conventional. The interpolated and quantized LSP coefficients are then converted back to the LPC predictor coefficients for use in each subframe by LSP to LPC conversion processor 255 in conventional fashion. This is done in both the encoder and the decoder. The LSP interpolation is important in maintaining the smooth reproduction of the output speech. The LSP interpolation allows the LPC predictor to be updated once a subframe (4 ms) in a smooth fashion. The resulting LPC predictor 20 is used to predict the coder's input signal. The difference between the input signal and its predicted version is the LPC prediction residual, d.

2. Pitch Prediction

Figure 3:
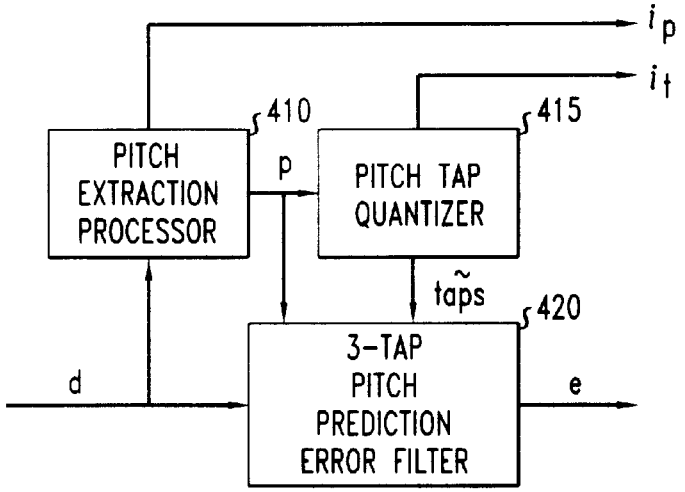
FIG. 3 presents a detailed block diagram of the pitch prediction processor of FIG. 1.
Figure 4:
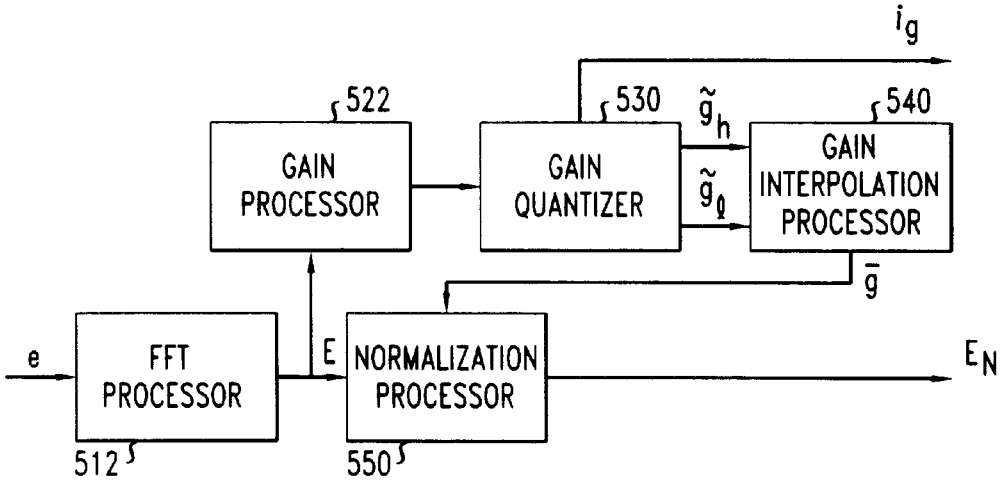
FIG. 4 presents a detailed block diagram of the transform processor of FIG. 1.
Figure 5:
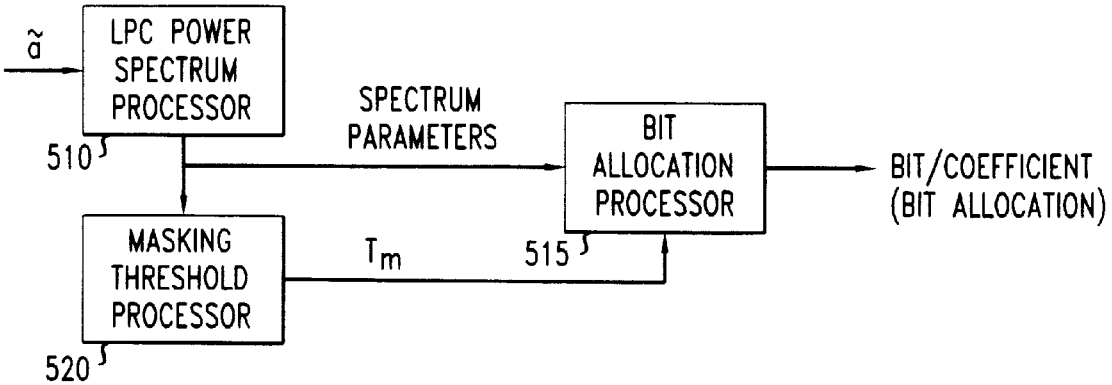
FIG. 5 presents a detailed block diagram of the hearing model and quantizer control processor of FIG. 1.

Pitch prediction processor 30 comprises a pitch extraction processor 410, a pitch tap quantizer 415, and three-tap pitch prediction error filter 420, as shown in FIG. 3. Processor 30 is used to remove the redundancy in the LPC prediction residual, d, due to pitch periodicity in voiced speech. The pitch estimate used by processor 30 is updated only once a frame (once every 20 ms). There are two kinds of parameters in pitch prediction which need to be quantized and transmitted to the decoder: the pitch period corresponding to the period of the nearly periodic waveform of voiced speech, and the three pitch predictor coefficients (taps).

The pitch period of the LPC prediction residual is determined by pitch extraction processor 410 using a modified version of the efficient two-stage search technique discussed in U.S. Pat. No. 5,327,520, entitled "Method of Use of Voice Message Coder/Decoder," and incorporated by reference as if set forth fully herein. Processor 410 first passes the LPC residual through a third-order elliptic lowpass filter to limit the bandwidth to about 800 Hz, and then performs 8:1 decimation of the lowpass filter output. The correlation coefficients of the decimated signal are calculated for time lags ranging from 4 to 35, which correspond to time lags of 32 to 280 samples in the undecimated signal domain. Thus, the allowable range for the pitch period is 2 ms to 17.5 ms, or 57 Hz to 500 Hz in terms of the pitch frequency. This is sufficient to cover the normal pitch range of essentially all speakers, including low-pitched males and high-pitched children.

After the correlation coefficients of the decimated signal are calculated by processor 410, the first major peak of the correlation coefficients which has the lowest time lag is identified. This is the first-stage search. Let the resulting time lag be t. This value t is multiplied by 8 to obtain the time lag in the undecimated signal domain. The resulting time lag, 8t, points to the neighborhood where the true pitch period is most likely to lie. To retain the original time resolution in the undecimated signal domain, a second-stage pitch search is conducted in the range of t−7 to t+7. The correlation coefficients of the original undecimated LPC residual, d, are calculated for the time lags of t−7 to t+7 (subject to the lower bound of 32 samples and upper bound of 280 samples). The time lag corresponding to the maximum correlation coefficient in this range is then identified as the final pitch period, p. This pitch period, p, is encoded into 8 bits with a conventional VQ codebook and the 8-bit codebook index, $i_p$, is provided to the MUX 70 for transmission to the decoder as side information. Eight bits are sufficient to represent the pitch period since there are only 280−32+1=249 possible integers that can be selected as the pitch period.

The three pitch predictor taps are jointly determined in quantized form by pitch-tap quantizer 415. Quantizer 415 comprises a conventional VQ codebook having 64 codevectors representing 64 possible sets of pitch predictor taps. The energy of the pitch prediction residual within the current frame is used as the distortion measure of a search through the codebook. Such a distortion measure gives a higher pitch prediction gain than a simple MSE measure on the predictor taps themselves. Normally, with this distortion measure the codebook search complexity would be very high if a brute-force approach were used. However, quantizer 415 employs an efficient codebook search technique well-known in the art (described in U.S. Pat. No. 5,327,520) for this distortion measure. While the details of this technique will not be presented here, the basic idea is as follows.

It can be shown that minimizing the residual energy distortion measure is equivalent to maximizing an inner product of two 9-dimensional vectors. One of these 9-dimensional vectors contains only correlation coefficients of the LPC prediction residual. The other 9-dimensional vector contains only the product terms derived from the set of three pitch predictor taps under evaluation. Since such a vector is signal-independent and depends only on the pitch tap codevector, there are only 64 such possible vectors (one for each pitch tap codevector), and they can be pre-computed and stored in a table—the VQ codebook. In an actual codebook search, the 9-dimensional vector of LPC residual correlation is calculated first. Next, the inner product of the resulting vector with each of the 64 pre-computed and stored 9-dimensional vectors is calculated. The vector in the stored table which gives the maximum inner product is the winner, and the three quantized pitch predictor taps are derived from it. Since there are 64 vectors in the stored table, a 6-bit index, $i_t$, is sufficient to represent the three quantized pitch predictor taps. These 6 bits are provided to the MUX 70 for transmission to the decoder as side information.

The quantized pitch period and pitch predictor taps determined as discussed above are used to update the pitch prediction error filter 420 once per frame. The quantized pitch period and pitch predictor taps are used by filter 420 to predict the LPC prediction residual. The predicted LPC prediction residual is then subtracted from the actual LPC prediction residual. After the predicted version is subtracted from the unquantized LPC residual, we have the unquantized pitch prediction residual, e, which will be encoded using the transform coding approach described below.

3. The Transform Coding of the Prediction Residual

The pitch prediction residual signal, e, is encoded subframe-by-subframe, by transform processor 40. A detailed block diagram of processor 40 is presented in FIG. 4. Processor 40 comprises, an FFT processor 512, a gain processor 522 a gain quantizer 530, a gain interpolation processor 540, and a normalization processor 550.

FFT processor 512 computes a conventional 64-point FFT for each subframe of the pitch prediction residual, e. This size transform avoids the so-called "pre-echo" distortion well-known in the audio coding art. See Jayant, N. et al., "Signal Compression Based on Models of Human Perception," *Proc. IEEE*, pp. 1385–1422, October 1993 which is incorporated by reference as if set forth fully herein.

a. Gain Computation and Quantization

After each 4 ms subframe of the prediction residual is transformed to the frequency domain by processor 512, gain levels (or Root-Mean Square (RMS) values) are extracted by gain processor 522 and quantized by gain quantizer 530 for the different frequency bands. For each of the five subframes in the current frame, two gain values are extracted by processor 522: (1) the RMS value of the first five FFT coefficients from processor 512 as a low-frequency (0 to 1 kHz) gain, and (2) the RMS value of the 17th through the 29th FFT coefficients from processor 512 as a high-frequency (4 to 7 kHz) gain. Thus, 2×5=10 gain values are extracted per frame for use by gain quantizer 530.

Separate quantization schemes are employed by gain quantizer 530 for the high-and the low-frequency gains in each frame. For the high-frequency (4–7 kHz) gains, quantizer 530 encodes the high-frequency gain of the last subframe of the current frame into 5 bits using conventional scalar quantization. This quantized gain is then converted by quantizer 530 into the logarithmic domain in terms of decibels (dB). Since there are only 32 possible quantized gain levels (with 5 bits), the 32 corresponding log gains are pre-computed and stored in a table, and the conversion of gain from the linear domain to the log domain is done by table look-up. Quantizer 530 then performs linear interpolation in the log domain between this resulting log gain and the log gain of the last subframe of the last frame. Such interpolation yields an approximation (i.e., a prediction) of the log gains for subframes 1 through 4. Next, the linear gains of subframes 1 through 4, supplied by gain processor 522, are converted to the log domain, and the interpolated log gains are subtracted from the results. This yields 4 log gain interpolation errors, which are grouped into two vectors each of dimension 2.

Each 2-dimensional log gain interpolation error vector is then conventionally vector quantized into 7 bits using a simple MSE distortion measure. The two 7-bit codebook indices, in addition to the 5-bit scalar representing the last subframe of the current frame, are provided to the MUX 72 for transmission to the decoder.

Gain quantizer 530 also adds the resulting 4 quantized log gain interpolation errors back to the 4 interpolated log gains to obtain the quantized log gains. These 4 quantized log gains are then converted back to the linear domain to get the 4 quantized high-frequency gains for subframe 1 through 4. These high-frequency quantized gains, together with the high-frequency quantized gain of subframe 5, are provided to gain interpolation processor 540, for processing as described below.

Gain quantizer 530 performs the quantization of the low-frequency (0–1 kHz) gains based on the quantized high-frequency gains and the quantized pitch predictor taps. The statistics of the log gain difference, which is obtained by subtracting the high-frequency log gain from the low-frequency log gain of the same subframe, is strongly influenced by the pitch predictor. For those frames without much pitch periodicity, the log gain difference would be roughly zero-mean and has a smaller standard deviation. On the other hand, for those frames with strong pitch periodicity, the log gain difference would have a large negative mean and a larger standard deviation. This observation forms the basis of an efficient quantizer for the 5 low-frequency gains in each frame.

For each of the 64 possible quantized set of pitch predictor taps, the conditional mean and conditional standard deviation of the log gain difference are precomputed using a large speech database. The resulting 64-entry tables are then used by gain quantizer 530 in the quantization of the low-frequency gains.

The low-frequency gain of the last subframe is quantized in the following way. The codebook index obtained while quantizing the pitch predictor taps is used in table look-up operations to extract the conditional mean and conditional standard deviation of the log gain difference for that particular quantized set of pitch predictor taps. The log gain difference of the last subframe is then calculated. The conditional mean is subtracted from this unquantized log gain difference, and the resulting mean-removed log gain difference is divided by the conditional standard deviation. This operation basically produces a zero-mean, unit-variance quantity which is quantized to 4 bits by gain quantizer 530 using scalar quantization.

The quantized value is then multiplied by the conditional standard deviation, and the result is added to the conditional mean to obtain a quantized log gain difference. Next, the quantized high-frequency log gain is added back to get the quantized low-frequency log gain of the last subframe. The resulting value is then used to perform linear interpolation of the low-frequency log gain for subframes 1 through 4. This interpolation occurs between the quantized low-frequency log gain of the last subframe of the previous frame and the quantized low-frequency log gain of the last subframe of the current frame.

The 4 low-frequency log gain interpolation errors are then calculated. First, the linear gains provided by gain processor 522 are converted to the log domain. Then, the interpolated low-frequency log gains are subtracted from the converted gains. The resulting log gain interpolation errors are normalized by the conditional standard deviation of the log gain difference. The normalized interpolation errors are then grouped into two vectors of dimension 2. These two vectors are each vector quantized into 7 bits using a simple MSE distortion measure, similar to the VQ scheme for the high-frequency case. The two 7-bit codebook indices, in addition to the 4-bit scalar representing the last subframe of the current frame, are provided to the MUX 72 for transmission to the decoder.

Gain quantizer also multiplies the 4 quantized values by the conditional standard deviation to restore the original scale, and then adds the interpolated log gain to the result. The resulting values are the quantized low-frequency log gains for subframes 1 through 4. Finally, all 5 quantized low-frequency log gains are converted to the linear domain for subsequent use by gain interpolation processor 540.

Gain interpolation processor 540 determines approximated gains for the frequency band of 1 to 4 kHz. First, the gain levels for the 13th through the 16th FFT coefficient (3 to 4 kHz) are chosen to be the same as the quantized high-frequency gain. Then, the gain levels for the 6th through the 12th FFT coefficient (1 to 3 kHz) are obtained by linear interpolation between the quantized low-frequency log gain and the quantized high-frequency log-gain. The resulting interpolated log gain values are then converted back to the linear domain. Thus, with the completion of the processing of the gain interpolation processor, each FFT coefficient from 0 to 7 kHz (or first through the 29th FFT coefficient) has either a quantized or an interpolated gain associated with it. A vector of these gain values is provided to the gain normalization processor 550 for subsequent processing.

Gain normalization processor 550 normalizes the FFT coefficients generated by FFT processor 512 by dividing each coefficient by its corresponding gain. The resulting gain-normalized FFT coefficients are then ready to be quantized by residual quantizer 60.

b. The Bit Stream

FIG. 7 presents the bit stream of the illustrative embodiment of the present invention. As described above, 49 bits/frame have been allocated for encoding LPC parameters, 8+6=14 bits/frame have been allocated for the 3-tap pitch predictor, and 5+(2×7)+4+(2×7)=37 bits/frame for the gains. Therefore, the total number of side information bits is 49+14+37=100 bits per 20 ms frame, or 20 bits per 4 ms subframe. Consider that the coder might be used at one of three different rates: 16, 24 and 32 kb/s. At a sampling rate of 16 kHz, these three target rates translate to 1, 1.5, and 2 bits/sample, or 64, 96, and 128 bits/subframe, respectively. With 20 bits/subframe used for side information, the numbers of bits remaining to use in encoding the main information (encoding of FFT coefficients) are 44, 76, and 108 bits/subframe for the three rates of 16, 24, and 32 kb/s, respectively.

c. Adaptive Bit Allocation

In accordance with the principles of the present invention, adaptive bit allocation is performed to assign these remaining bits to various parts of the frequency spectrum with different quantization accuracy, in order enhance the perceptual quality of the output speech at the TPC decoder. This is done by using a model of human sensitivity to noise in audio signals. Such models are known in the art of perceptual audio coding. See, e.g., Tobias, J. V., ed., *Foundations of Modern Auditory Theory*, Academic Press, New York and London, 1970. See also Schroeder, M. R. et al., "Optimizing Digital Speech Coders by Exploiting Masking Properties of the Human Ear," J. Acoust. Soc. Amer., 66:1647–1652, December 1979 (Schroeder, et al.), which is hereby incorporated by reference as if fully set forth herein.

Hearing model and quantizer control processor 50 comprises LPC power spectrum processor 510, masking threshold processor 515, and bit allocation processor 520. While adaptive bit allocation might be performed once every subframe, the illustrative embodiment of the present invention performs bit allocation once per frame in order to reduce computational complexity.

Rather than using the unquantized input signal to derive the noise masking threshold and bit allocation, as is done in conventional music coders, the noise masking threshold and bit allocation of the illustrative embodiment are determined from the frequency response of the quantized LPC synthesis filter (which is often referred to as the "LPC spectrum"). The LPC spectrum can be considered an approximation of the spectral envelope of the input signal within the 24 ms LPC analysis window. The LPC spectrum is determined based on the quantized LPC coefficients. The quantized LPC coefficients are provided by the LPC analysis processor 10 to the LPC spectrum processor 510 of the hearing model and quantizer control processor 50. Processor 510 determines the LPC spectrum as follows. The quantized LPC filter coefficients ($\hat{a}$) are first transformed by a 64-point FFT. The power of the first 33 FFT coefficients is determined and the reciprocals of these power values are then calculated. The result is the LPC power spectrum which has the frequency resolution of a 64-point FFT.

After the LPC power spectrum is determined, an estimated noise masking threshold is computed by the masking threshold processor 515. The masking threshold, $T_M$, is calculated using a modified version of the method described in U.S. Pat. No. 5,341,457, which is incorporated by reference as if fully set forth herein. Processor 515 scales the 33 samples of LPC power spectrum from processor 510 by a frequency-dependent attenuation function empirically determined from subjective listening experiments. As shown in FIG. 6, the attenuation function starts at 12 dB for the DC term of the LPC power spectrun, increases to about 15 dB between 700 and 800 Hz, then decreases monotonically toward high frequencies, and finally reduces to 6 dB at 8000 Hz.

Figure 9:
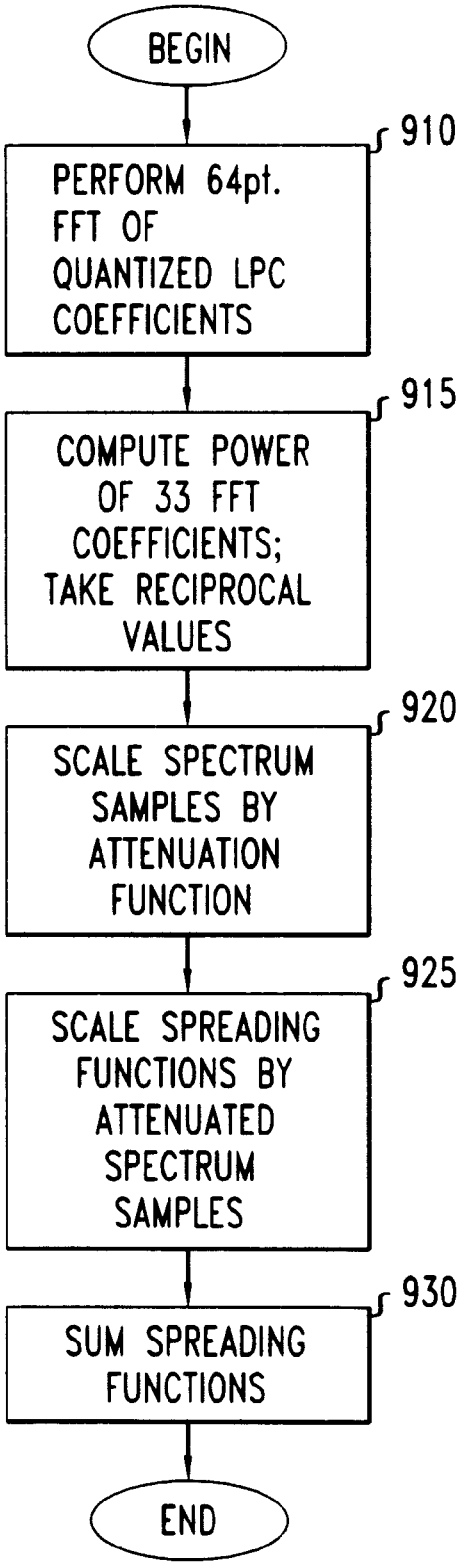
FIG. 9 presents a flow diagram illustrating processing performed to determine an estimated masking threshold function.

Each of the 33 attenuated LPC power spectrum samples is then used to scale a "basilar membrane spreading function" derived for that particular frequency to calculate the masking threshold. A spreading function for a given frequency corresponds to the shape of the masking threshold in response to a single-tone masker signal at that frequency. Equation (5) of Schroeder, et al. describes such spreading functions in terms of the "bark" frequency scale, or critical-band frequency scale is incorporated by reference as if set forth fully herein. The scaling process begins with the first 33 frequencies of a 64-point FFT across 0–16 kHz (i.e., 0 Hz, 250 Hz, 500 Hz, . . . , 8000 Hz) being converted to the "bark" frequency scale. Then, for each of the 33 resulting bark values, the corresponding spreading function is sampled at these 33 bark values using equation (5) of Schroeder et al. The 33 resulting spreading functions are stored in a table, which may be done as part of an off-line process. To calculate the estimated masking threshold, each of the 33 spreading functions is multiplied by the corresponding sample value of the attenuated LPC power spectrum, and the resulting 33 scaled spreading functions are summed together. The result is the estimated masking threshold function which is provided to bit allocation processor 520. FIG. 9 presents the processing performed by processor 520 to determine the estimated masking threshold function.

It should be noted that this technique for estimating the masking threshold is not the only technique available.

Figure 11:
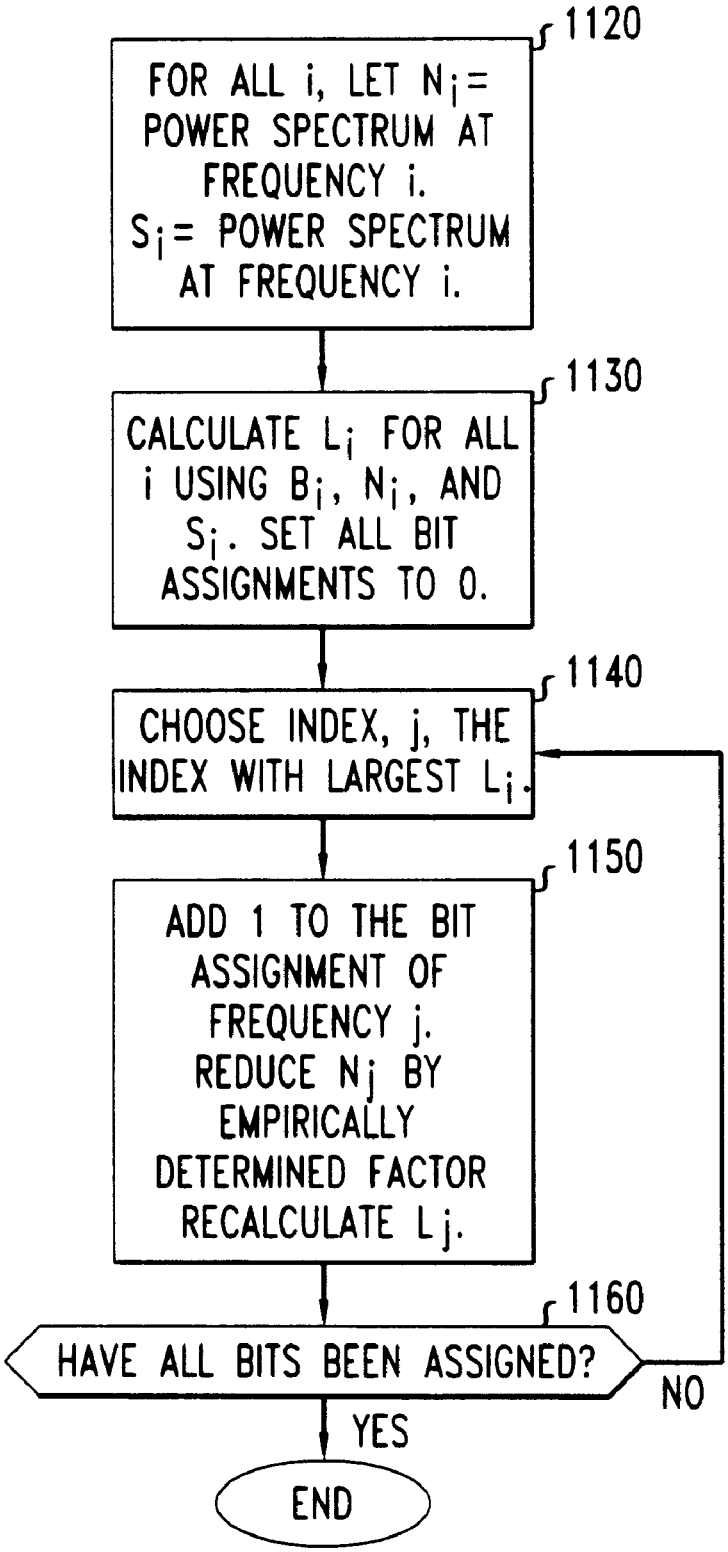
FIG. 11 presents a flow diagram describing an illustrative bit allocation procedure such as that employed, for example, by bit allocation processor 520 of the illustrative hearing model and quantizer control processor shown in FIG. 5.

To keep the complexity low, the bit allocation processor 520 uses a "greedy" technique to allocate the bits for residual quantization. The technique is "greedy" in the sense that it allocates one bit at a time to the most "needy" frequency component without regard to its potential influence on future bit allocation. FIG. 11 presents the processing performed by processor 520 to perform the allocation of bits for residual quantization. Initialization of the process is shown in block 1120 thereof.

At the beginning when no bit is assigned yet, the corresponding output speech will be zero, and the coding error signal is the input speech itself. Therefore, initially the LPC power spectrum is assumed to be the power spectrum of the coding noise. Then, the noise loudness at each of the 33 frequencies of a 64-point FFT is estimated using the masking threshold calculated above and a simplified version of the noise loudness calculation method in Schroeder et al.

The simplified noise loudness at each of the 33 frequencies is calculated by processor 520 as follows. First, the critical bandwidth $B_i$ at the i-th frequency is calculated using linear interpolation of the critical bandwidth listed in table 1 of Scharf's book chapter in Tobias. The result is the approximated value of the term df/dx in equation (3) of Schroeder et al. The 33 critical bandwidth values are pre-computed and stored in a table. Then, for the i-th frequency, the noise power $N_i$ is compared with the masking threshold $M_i$. If $N_i \leqq M_i$, the noise loudness $L_i$ is set to zero. If $N_i > M_i$, then the noise loudness is calculated as $$L_i = B_i((N_i - M_i)/(1+(S_i/N_i)^2))^{0.25}$$

where $S_i$ is the sample value of the LPC power spectrum at the i-th frequency as shown in block 1130 of FIG. 11.

Once the noise loudness is calculated by processor 520 for all 33 frequencies, the frequency with the maximum noise loudness is identified (as shown in block 1140 of FIG. 11) and one bit is assigned to this frequency. The noise power at this frequency is then reduced by a factor which is empirically determined from the signal-to-noise ratio (SNR) obtained during the design of the VQ codebook for quantizing the prediction residual FFT coefficients. (Illustrative values for the reduction factor are between 4 and 5 dB). The noise loudness at this frequency is then updated using the reduced noise power. (See block 1150 of FIG. 11.) Next, the maximum is again identified from the updated noise loudness array, and one bit is assign to the corresponding frequency. This process continues until all available bits are exhausted. (See block 1160 of FIG. 11.)

For the 32 and 24 kb/s TPC coder, each of the 33 frequencies can receive bits during adaptive bit allocation. For the 16 kb/s TPC coder, on the other hand, better speech quality can be achieved if the coder assigns bits only to the frequency range of 0 to 4 kHz (i.e., the first 16 FFT coefficients) and synthesizes the residual FFT coefficients in the higher frequency band of 4 to 8 kHz. The method for synthesizing the residual FFT coefficients from 4 to 8 kHz will be described below in connection with the illustrative decoder.

Note that since the quantized LPC synthesis coefficients ($\tilde{a}$) are also available at the TPC decoder, there is no need to transmit the bit allocation information. This bit allocation information is determined by a replica of the hearing model quantizer control processor 50 in the decoder. Thus, the TPC decoder can locally duplicate the encoder's adaptive bit allocation operation to obtain such bit allocation information.

d. Quantization of FFT Coefficients

Once the bit allocation is done, the actual quantization of normalized prediction residual FFT coefficients, $E_N$, is performed by quantizer 60. The DC term of the FFT is a real number, and it is scalar quantized if it ever receives any bit during bit allocation. The maximum number of bits it can receive is 4. For second through the 16th FFT coefficients, a conventional two-dimensional vector quantizer is used to quantize the real and imaginary parts jointly. The maximum number of bits for this 2-dimension VQ is 6 bits. For the 17th through the 30th FFT coefficients, a conventional 4-dimensional vector quantizer is used to quantize the real and imaginary parts of two adjacent FFT coefficients.

C. An Illustrative Decoder Embodiment

An illustrative decoder embodiment of the present invention is presented in FIG. 8. The illustrative decoder comprises a demultiplexer (DEMUX) 65, an LPC parameter decoder 80, a hearing model dequantizer control processor 90, a dequantizer 70, an inverse transform processor 100, a pitch synthesis filter 110, and an LPC synthesis filter 120, connected as shown in FIG. 8. As a general proposition, the decoder embodiment perform the inverse of the operations performed by the illustrative coder on the main information.

For each frame, the DEMUX 65 separates all main and side information components from the received bit-stream. The main information is provided to dequantizer 70. The term "dequantize" used herein refers to the generation of a quantized output based on a coded value, such as an index. In order to dequantize this main information, adaptive bit allocation must be performed to determine how many of the main information bits are associated with each quantized transform coefficient of main information.

The first step in adaptive bit allocation is the generation of quantized LPC coefficients (upon which allocation depends). As discussed above, seven LSP codebook indices, $i_l(1)$–$i_l(7)$, are communicated over the channel to the decoder to represent quantized LSP coefficients. Quantized LSP coefficients are synthesized by decoder 80 with use of a copy of the LSP codebook (discussed above) in response to the received LSP indices from the DEMUX 65. Finally, LPC coefficients are derived from the LSP coefficients in conventional fashion.

With LPC coefficients, $\tilde{a}$, synthesized, hearing model dequantizer control processor 90 determines the bit allocation (based on the quantized LPC parameters) for each FFT coefficient in the same way discussed above in reference to the coder. (See FIG. 11 and the discussion thereof, above.) Once the bit allocation information is derived, the dequantizer 70 can then correctly decode the main FFT coefficient information and obtain the quantized versions of the gain-normalized prediction residual FFT coefficients.

For those frequencies which receive no bits at all, the decoded FFT coefficients will be zero. The locations of such "spectral holes" evolve with time, and this may result in a distinct artificial distortion which is quite common to many transform coders. To avoid such artificial distortion, dequantizer 70 "fills in" the spectral holes with low-level FFT coefficients having random phases and magnitudes equal to 3 dB below the quantized gain.

Figure 10:
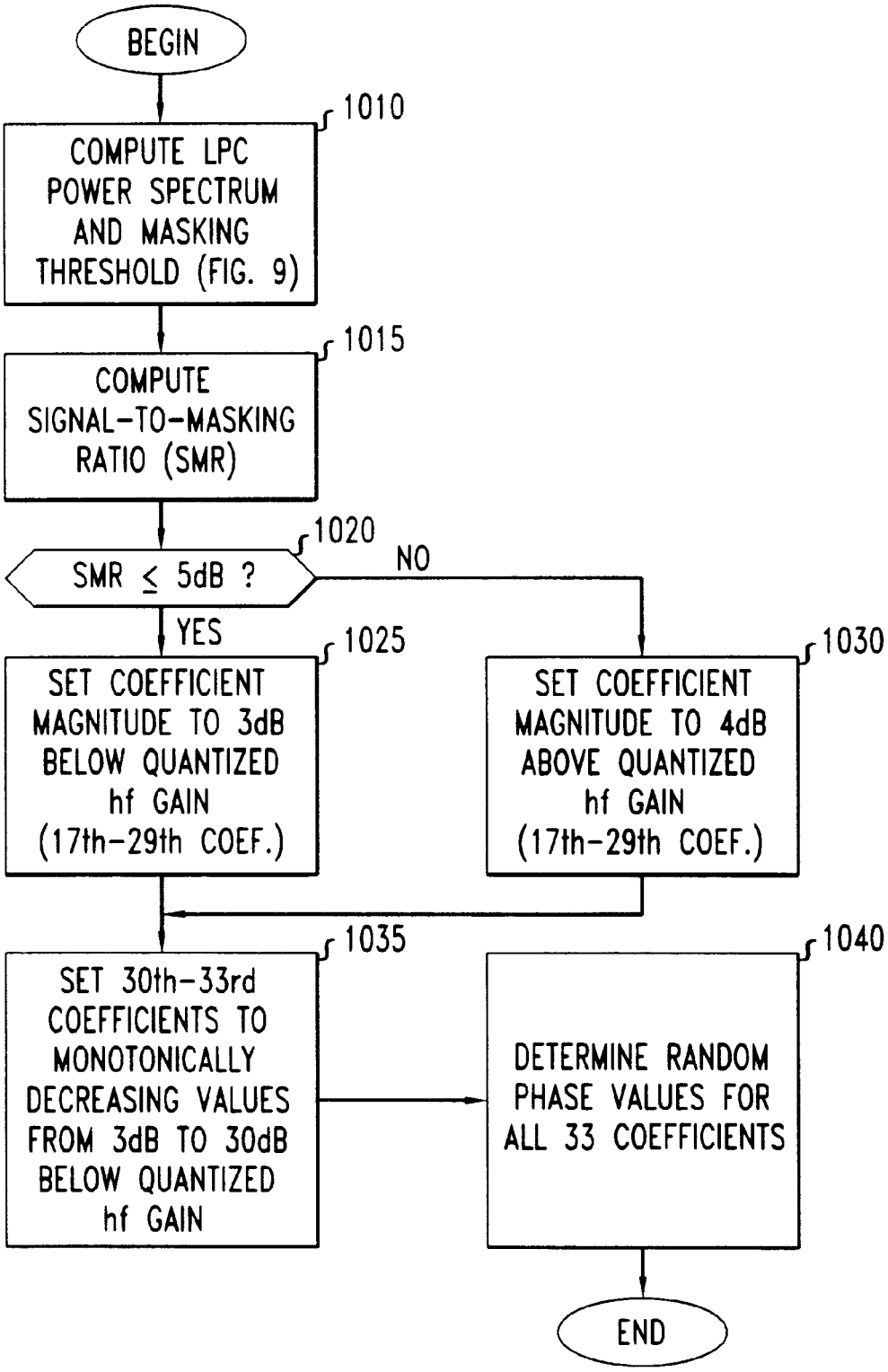
FIG. 10 presents a flow diagram illustrating processing performed to synthesize the magnitude and phase of residual fast Fourier transform coefficients for use by the decoder of FIG. 8.

For 32 and 24 kb/s coders, bit allocation is performed for the entire frequency band, as described above in the discussion of the encoder. For the 16 kb/s coder, bit allocation is restricted to the 0 to 4 kHz band. The 4 to 8 kHz band is synthesized in the following way. First, the ratio between the LPC power spectrum and the masking threshold, or the signal-to-masking-threshold ratio (SMR), is calculated for the frequencies in 4 to 7 kHz. The 17th through the 29th FFT coefficients (4 to 7 kHz) are synthesized using phases which are random and magnitude values that are controlled by the SMR. For those frequencies with SMR>5 dB, the magnitude of the residual FFT coefficients is set to 4 dB above the quantized high-frequency gain (RMS value of FFT coefficients in the 4 to 7 kHz band). For those frequencies with SMR≦5 dB, the magnitude is 3 dB below the quantized high-frequency gain. From the 30th through the 33rd FFT coefficients, the magnitude ramps down from 3 dB to 30 dB below the quantized high-frequency gain, and the phase is again random. FIG. 10 illustrates the processing which synthesizes the magnitude and phase of the FFT coefficients.

Once all FFT coefficients are decoded, filled in, or synthesized, they are ready for scaling. Scaling is accomplished by inverse transform processor 100 which receives (from DEMUX 65) a 5 bit index for the high-frequency gain and a 4 bit index for the low frequency gain, each corresponding to the last subframe of the current frame, as well as indices for the log gain interpolation errors for the low- and high-frequency bands of the first four subframes. These gain indices are decoded, and the results are used to obtain the scaling factor for each FFT coefficient, as described above in the section describing gain computation and quantization. The FFT coefficients are then scaled by their individual gains.

The resulting gain-scaled, quantized FFT coefficients are then transformed back to the time domain by inverse transform processor 100 using an inverse FFT. This inverse transform yields the time-domain quantized prediction residual, $\tilde{e}$.

The time-domain quantized prediction residual, $\tilde{e}$ is then passed through the pitch synthesis filter 110. Filter 110 adds pitch periodicity to the residual based on a quantized pitch-period, $\tilde{p}$, to yield $\tilde{d}$, the quantized LPC prediction residual. The quantized pitch-period is decoded from the 8 bit index, $i_p$, obtained from DEMUX 65. The pitch predictor taps are decoded from the 6-bit index $i_t$, also obtained from DEMUX 65.

Finally, the quantized output speech, $\tilde{s}$, is then generated by LPC synthesis filter 120 using the quantized LPC coefficients, $\tilde{a}$, obtained from LPC parameter decoder 80.

D. Discussion

Although a number of specific embodiments of this invention have been shown and described herein, it is to be understood that these embodiments are merely illustrative of the many possible specific arrangements which can be devised in application of the principles of the invention. In light of the disclosure above, numerous and varied other arrangements may be devised in accordance with these principles by those of ordinary skill in the art without departing from the spirit and scope of the invention.

For example, good speech and music quality may be maintained by coding only the FFT phase information in the 4 to 7 kHz band for those frequencies where SMR>5 dB. The magnitude is the determined in the same way as the high-frequency synthesis method described near the end of the discussion of bit allocation.

Most CELP coders update the pitch predictor parameters once every 4 to 6 ms to achieve more efficient pitch prediction. This is much more frequent than the 20 ms updates of the illustrative embodiment of the TPC coder. As such, other update rates are possible, for example, every 10 ms.

Other ways to estimate the noise loudness may be used. Also, rather than minimizing the maximum noise loudness, the sum of noise loudness for all frequencies may be minimized. The gain quantization scheme described previously in the encoder section has a reasonably good coding efficiency and works well for speech signals. An alternative gain quantization scheme is described below. It may not have quite as good a coding efficiency, but it is considerably simpler and may be more robust to non-speech signals.

The alternative scheme starts with the calculation of a "frame gain," which is the RMS value of the time-domain pitch prediction residual signal calculated over the entire frame. This value is then converted to dB values and quantized to 5 bits with a scalar quantizer. For each subframe, three gain values are calculated from the residual FFT coefficients. The low-frequency gain and the high-frequency gain are calculated the same way as before, i.e. the RMS value of the first 5 FFT coefficients and the RMS value of the 17th through the 29th FFT coefficients. In addition, the middle-frequency gain is calculated as the RMS value of the 6th through the 16th FFT coefficients. These three gain values are converted to dB values, and the frame gain in dB is subtracted from them. The result is the normalized subframe gains for the three frequency bands.

The normalized low-frequency subframe gain is quantized by a 4-bit scalar quantizer. The normalized middle-frequency and high-frequency subframe gains are jointly quantized by a 7-bit vector quantizer. To obtain the quantized subframe gains in the linear domain, the frame gain in dB is added back to the quantized version of the normalized subframe gains, and the result is converted back to the linear domain.

Unlike the previous method where linear interpolation was performed to obtain the gains for the frequency band of 1 to 4 kHz, this alternative method does not need that interpolation. Every residual FFT coefficient belongs to one of the three frequency bands where a dedicated subframe gain is determined. Each of the three quantized subframe gains in the linear domain is used to normalize or scale all residual FFT coefficients in the frequency band where the subframe gain is derived from.

Note that this alternative gain quantization scheme takes more bits to specify all the gains. Therefore, for a given bit-rate, fewer bits are available for quantizing the residual FFT coefficients.

The invention claimed is:

1. A method of generating coefficient signals representing frequency components of a signal representing speech information based on an estimate of the signal spectrum and a noise masking measure associated with the speech signal, the method comprising:

generating a first signal relating the estimate of the signal spectrum to the noise masking measure at each of one or more frequencies;

for one or more of said frequencies, forming a coefficient signal magnitude based on said first signal at a corresponding frequency, and selecting a coefficient phase at random, wherein the step of forming a coefficient signal magnitude comprises forming the magnitude as a function of a quantized gain signal associated with the frequency corresponding to said coefficient, wherein the first signal relating the estimate of the signal spectrum to the noise masking measure at each of one or more frequencies comprises a ratio of the estimate of the signal spectrum to a perceptual threshold signal, and wherein when said ratio is greater than a predetermined threshold, the magnitude of said coefficients is at least a predetermined amount above said gain signal evaluated at said frequency.

2. The method of claim 1 wherein the estimate of the signal spectrum comprises a quantized LPC power spectrum.

3. The method of claim 1 wherein the predetermined threshold is approximately 5 dB and the predetermined amount is approximately 4 dB.

4. A method of generating coefficient signals representing frequency components of a signal representing speech information based on an estimate of the signal spectrum and a noise masking measure associated with the speech signal, the method comprising:

generating a first signal relating the estimate of the signal spectrum to the noise masking measure at each of one or more frequencies;

for one or more of said frequencies, forming a coefficient signal magnitude based on said first signal at a corresponding frequency, and selecting a coefficient phase at random, wherein the step of forming a coefficient signal magnitude comprises forming the magnitude as a function of a quantized gain signal associated with the frequency corresponding to said coefficient, wherein the first signal relating the estimate of the signal spectrum to the noise masking measure at each of one or more frequencies comprises a ratio of the estimate of the signal spectrum to a perceptual threshold signal, and wherein when said ratio is less than or equal to a predetermined threshold, the magnitude of said coefficients is at least a predetermined amount below said gain signal evaluated at said frequency.

5. The method of claim 4 wherein the estimate of the signal spectrum comprises a quantized LPC power spectrum.

6. The method of claim 4 wherein the predetermined threshold is approximately 5 dB and the predetermined amount is approximately 3 dB.

* * * * *